United States Patent [19]

Ahern

[11] Patent Number: 4,548,216

[45] Date of Patent: Oct. 22, 1985

[54] CIGARETTE MANUFACTURE

[75] Inventor: Ronald A. Ahern, High Wycombe, England

[73] Assignee: Molins Limited, London, England

[21] Appl. No.: 441,178

[22] Filed: Nov. 12, 1982

Related U.S. Application Data

[63] Continuation-in-part of Ser. No. 248,447, Mar. 27, 1981, abandoned.

[51] Int. Cl.[4] ..... A24C 5/47; A24C 5/52

[52] U.S. Cl. ..... 131/94; 131/95; 131/61.1; 131/84.4

[58] Field of Search ..... 131/282, 283, 94, 61 R, 131/84 C, 95, 61 A, 84 R, 84 B; 493/45, 47, 74

[56] References Cited

U.S. PATENT DOCUMENTS

| | | | |
|---|---|---|---|
| Re. 30,865 | 2/1982 | Marritt et al. | 131/61 A |
| 2,152,416 | 3/1939 | Molins | 131/94 |
| 2,205,943 | 6/1940 | Davidson | 131/95 |
| 2,866,464 | 12/1958 | Stone | 131/61 A |
| 3,039,367 | 6/1962 | Stelzer | 131/95 |
| 3,391,699 | 7/1968 | Stericker | 131/61 A |
| 3,404,689 | 10/1968 | Schubert | 131/95 |
| 3,948,276 | 4/1976 | Prandini | 131/283 |
| 4,077,415 | 3/1978 | Preston et al. | 131/94 |
| 4,196,740 | 4/1980 | Rudszinat | 131/84 C |
| 4,283,187 | 8/1981 | Molins et al. | 493/48 |

FOREIGN PATENT DOCUMENTS

| | | | |
|---|---|---|---|
| 2036035 | 4/1971 | Fed. Rep. of Germany | 493/45 |

*Primary Examiner*—V. Millin
*Assistant Examiner*—H. Macey
*Attorney, Agent, or Firm*—Antonelli, Terry & Wands

[57] ABSTRACT

This invention is concerned with the manufacture of double cigarette units each consisting of a double-length tobacco rod having filters secured to its opposite ends. Cutting in half of such double cigarette units to form separate filter cigarettes may be delayed until just prior to packing of the cigarettes, until which time the filters at the ends of the double cigarette units seal in the tobacco. The manufacture of double cigarette units according to this invention is an in-line process in which double tobacco rods and intervening double filters are joined by portions of tipping paper while moving axially so as to form a continuous rod which is then cut through the middle of the double filters to produce the desired double cigarette units.

7 Claims, 3 Drawing Figures

CIGARETTE MANUFACTURE

The invention is a continuation-in-part of U.S. patent application Ser. No. 06/248,447, filed 3/27/81, now abandoned.

This invention is concerned with the manufacture of double-tipped cigarette units, each comprising a double-length tobacco rod to each end of which a filter portion is secured; such units will, for convenience, be referred to as "double cigarette units". In accordance with the invention described in co-pending U.S. patent application Ser. No. 786502, filed Apr. 11, 1977 (and in corresponding British Pat. No. 1,584,551), such cigarette units may be conveyed to a packing machine at, near or in which the units are cut through the middle to form individual filter-tipped cigarettes. In that way, the tobacco is positively retained until just prior to packing of the cigarettes.

According to the present invention, such double cigarette units are made by forming a continuous tobacco-filled rod (in any known manner), cutting the rod at regular intervals to form double-length tobacco rods, spacing the tobacco rods apart while they are moving longitudinally, inserting double-length filter portions between successive rods, applying strips of uniting material at regular intervals so that each strip extends along the entire length of a double-filter portion and overlaps the adjacent ends of the adjacent tobacco rods, wrapping the strips around the tobacco and filter portions to form a continuous rod comprising alternate double-tobacco and double-filter portions, and then cutting the continuous rod through the middle of each double-filter portion to form the desired double-cigarette units.

The invention avoids the production of "ring-tipped" cigarettes, as described in the above-mentioned patent application. In other words, this invention enables conventional filter-tipped cigarettes to be made, with the "cork" or other uniting web surrounding the entire filter portion instead of only the end adjacent to the tobacco rod.

The term "tobacco" in this content is intended to include any smokable material or mixture of such materials, including possibly reconstituted tobacco or synthetic tobacco or both.

Examples of machines according to this invention are shown in the accompanying diagrammatic drawings. In these drawings.

Figures 1, 3:
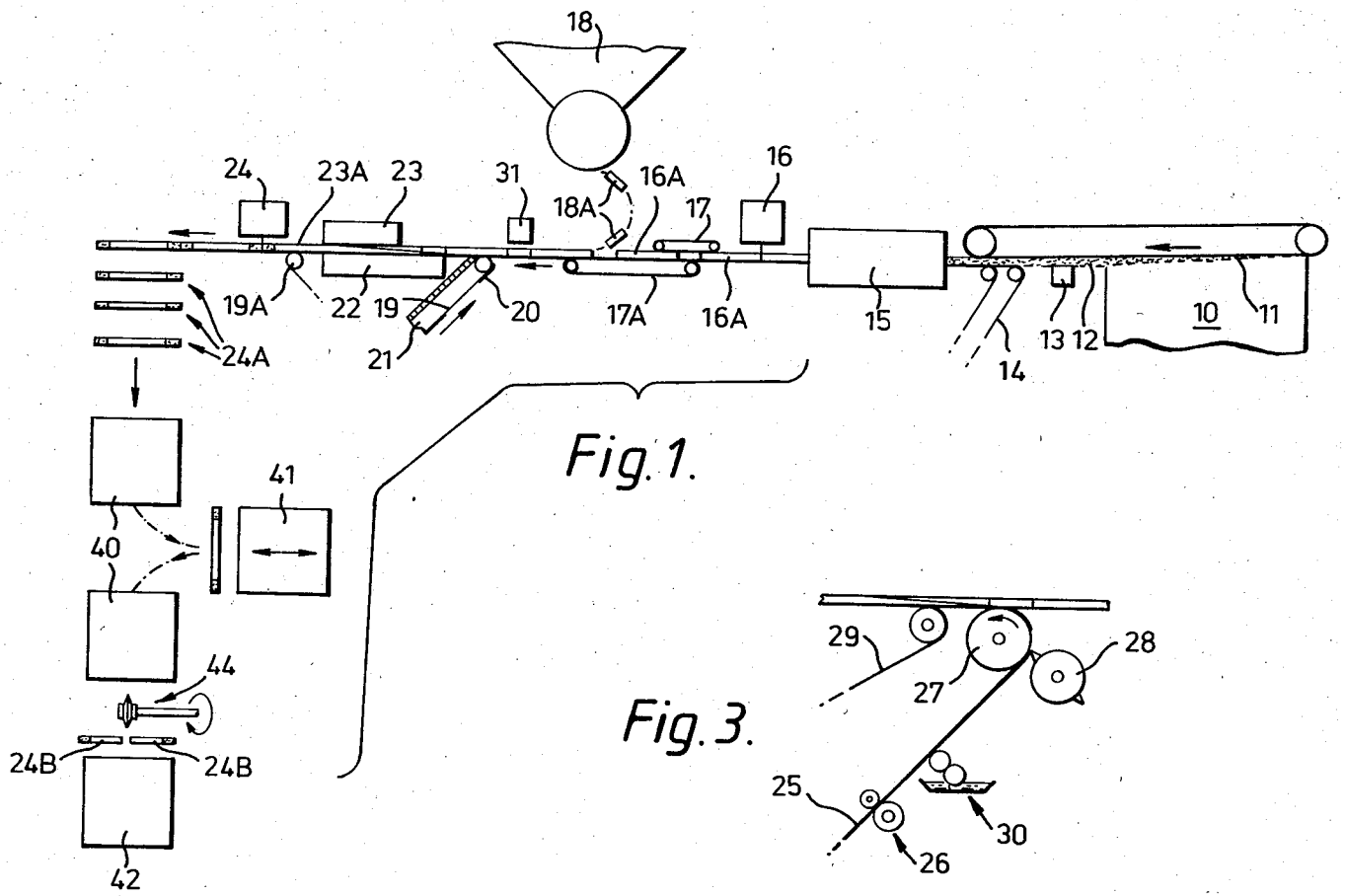
FIG. 1 is a diagrammatic overall view of one machine.

FIG. 1 shows a basic cigarette making machine comprising a chimney 10 up which tobacco is showered, by means of an upward-moving air-stream, onto a suction band 11 to form a continuous cigarette filler stream 12. The filler stream is trimmed by a trimming device 13 and is then deposited on a continuous wrapper web 14 which is wrapped around the filler stream in a rod-forming section 15 to form a continuous cigarette rod. Further details of the machine may be similar to the Molins Mark 8 or Mark 9 cigarette making machine, though other completely different forms of machine may be used for this purpose.

The continuous cigarette rod is cut at regular intervals by a cutting device 16 to form double-length tobacco rods 16A. These rods are then spaced apart, for example by means of a faster moving suction band 17, to produce gaps between which double-length filter portions 18A are fed by a device 18. This device 18 may be as described in our British patent application No. 33950/73, Ser. No. 1,471,534.

The stream of alternate cigarette and filter rods is then conveyed forward by a band 17A and is closed up so as to eliminate the gaps between successive rods. The stream of rods is then fed onto an endless air-pervious tape 19 (returning around a pulley 19A) which carries on its outer surface spaced web portions 20 with the aid of suction applied through the tape 19 from a suction chamber 21. Each web portion 20 is applied over one double-filter rod and overlaps onto the ends of the adjacent tobacco rods. The web 19 moves along a bed member 22 which progressively bends the tape 19 and consequently also the web portions 20 into a U-section, after which the upper edges of the web portions 20 are bent further around the rod by a device 23 so as to be wrapped completely around the rods.

The composite rod 23A which is thus formed is then cut at regular intervals by a cutting device 24 to form double-cigarette units 24A of the construction already described. These cigarette units are then conveyed by conveying apparatus 40 to a packing machine 42 including cutting means 44 by which the double-cigarette units are cut through the middle to form individual filter-tipped cigarettes 24B just prior to entering the device in the packing machine whereby, in a conventional manner, groups of individual cigarettes are prepared for packaging. The conveying apparatus 40 includes or has associated therewith a cigarette storage apparatus 41, for example in the form of a reversible reservoir (as diagrammatically illustrated) or tray system, for accommodating differences from time to time between the rates at which cigarettes are made by the making machine and packed by the packing machine.

The device 23 which completes the wrapping of the web portions 20 around the rods may, for example, comprise a pair of rotary tucker members each having one or more web-engaging parts which fold over the edges of successive web portions when the web portions are aligned with the device 22. Alternatively, the final stage of folding over the edges of the web portions may be achieved by means of stationary folding members.

Other known means of spacing apart the tobacco rods may be used. Such means were used in early designs of our filter attachment machines, for example as described in British patent specification No. 871,517.

Figure 2:
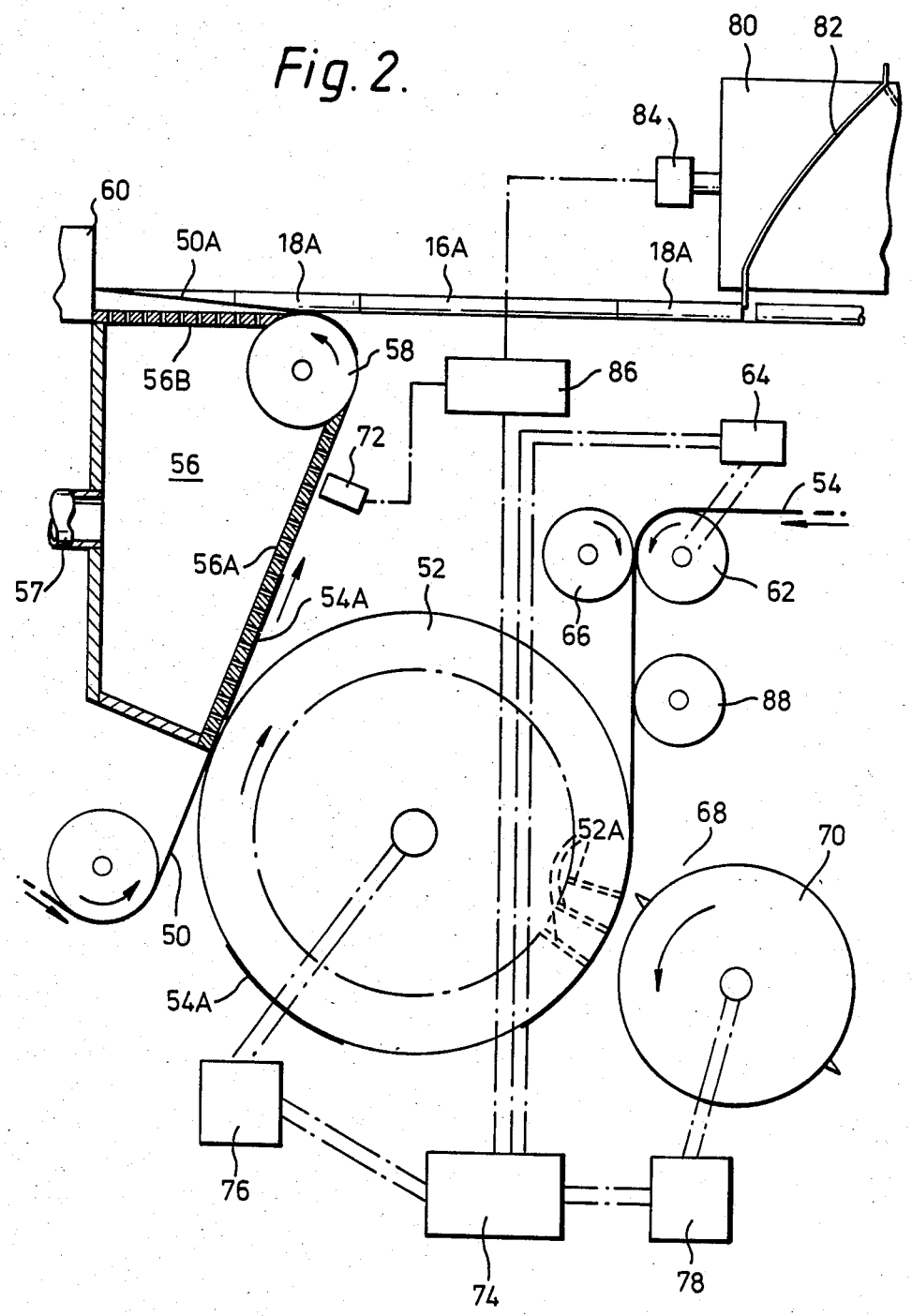
FIG. 2 shows a modification of part of the machine shown in FIG. 1; and, FIG. 3 shows another modification of part of the machine shown in FIG. 1.

FIG. 2 illustrates diagrammatically an arrangement for feeding portions of uniting material onto the tape 19 in FIG. 1. In FIG. 2 the corresponding tape is identified by the reference numeral 50. The tape (which again is air-pervious) is arranged to move generally upwardly past and close to a drum 52 from which it receives portions 54A of adhesive-coated "cork" patches cut from a "cork" web 54. Suction applied through the tape 50 from a suction chamber 56 holds the patches on the tape while the latter passes around a pulley 58 and then proceeds to move horizontally in contact with the cigarette and filter portions 16A and 18A towards a device 60 by which the tape 50 is progressively folded around the rod portions in the manner previously described.

Suction is supplied to the suction chamber 56 from a suitable source via a pipe 57.

As shown in FIG. 2, the edges 50A of the tape 50 begin to be folded up immediately after the tape has pased around the pulley 58, thereby beginning the operation of wrapping the patches 54A around the rod portions in the manner described above.

While carrying and conveying the "cork" patches by means of suction, the tape 50 is supported by perforated plates 56A and 56B. It should be noted that the patches continue to be gripped against the tape by suction while the folding of the patches around the rod portions is taking place prior to entry into the device 60 (and possibly also while in the device 60), thereby preventing the uncontrolled flapping of the side edges of the patches. For that purpose, the perforated plate 56B forming an upper wall of the suction chamber 56 is of concave cross-section. Furthermore, it should be understood that the pulley 58 is constructed so as to enable suction to be transmitted through it to hold the "cork" patches 54A securely on the tape 50 while passing around the pulley.

Delivery of timed "cork" patches to the tape 50 is achieved as follows. A web feed roller 62 is driven by drive means 64 at a speed such that the web advances towards the drum 52 at a speed substantially less than the peripheral speed of the drum 52. A pressure roller 66 presses the web firmly against the roller 62 to ensure that the web speed corresponds exactly to the peripheral speed of the roller 62.

The drum 52 has radial passages 52A communicating with an internal source of suction (not shown) whereby the web and subsequently also the portions 54A cut therefrom are held by suction against the surface of the drum 52. This suction gripping effect, however, enables the web to slip with respect to the drum 52 until a leading portion of the web is severed by one of a number of knives 68 on a rotary web cutter 70. The cutting edges of the knives 68 move at a speed equal to the peripheral speed of the drum 52 so as to cut the web with a pinching action at precise intervals. The arrangement is such that each portion 54A ("cork" patch) cut from the web is of predetermined length and is spaced from the preceeding and following portion by a predetermined distance.

This equipment can readily be set to produce "cork" patches on the drum 52 of predetermined length and at predetermined distances apart. However, during the transfer of the "cork" patches to the tape 50 it is possible for slight slippage to occur; for example, a valve is required inside the drum 52 to cut off the supply of suction to the ports in the drum to enable the "cork" patches to be released from the drum for transfer to the tape 50, and if the timing of the suction cut-off is inexact or alters, then the timing of "cork" patches on the tape 50 may be affected. Correspondingly, if the coefficient of friction of the outer surface of the tape 50 alters, then that could affect the timing of the "cork" patches as they proceed on the tape 50. Furthermore, other factors can arise which necessitate control of the timing of "cork" patches with respect to the rod portions 16A and 18A. In order to deal with all these problems, an optical sensor 72 is provided to detect the arrival of the leading edge of each "cork" portion 54A on the tape 50, and this sensor is arranged to control drive means 74 whereby the drum 52, cutter 70 and feed roller 62 are driven via drive means 76, 78 and 64.

The control means 74 may comprise an independent speed-controllable motor or alternatively a differential gearbox coupling a main drive motor to the respective drives 76, 78 and 64.

The timing of arrival of "cork" patches on the tape 50 is controlled in relation to the rotation of a timing drum 80 having an approximately helical cam portion 82 whereby successive filter portions 18A are pushed forward to abut the preceding cigarette portion 16A and in order to determine precisely the timing of the filter portions in the rod assembly apparatus. The timing drum 80 may be substantially as described in British patent specification No. 971,492.

A signal from a rotational position detecting device 84 associated with the drum 80 is fed to a controller 86 which also receives signals from the detector 72 and in turn controls the control means 74.

On its way towards the drum 52, the web 54 receives a coating of adhesive from an applicator roller 88 which may be in any known form.

FIG. 3 shows a modified arrangement for feeding strips of uniting material onto the rods. A continuous web 25 of uniting material (e.g. "cork") is fed at a controlled speed by rollers 26 towards a drum 27 which rotates with a peripheral speed greater than the speed of the web. A cutting device 28 cooperates with the drum 27 to cut the web at regular intervals, and the strips 25A cut off the web are carried further on the drum through the action of suction ports in the surface of the drum in a manner generally similar to that shown in FIG. 2. The drum 27 in this case applies the strips or "cork" patches directly to the rods, and folding of the strips around the rods is started, as soon as possible thereafter, by a tape 29 acting somewhat like a garniture tape in a conventional cigarette making machine. The completion of folding may be achieved by means of one or more rotary tuckers or by one or more stationary folders or by a combination of both.

Adhesive is preferably applied to the outer surface of the web 25, by means of an applicator roller device 30, before the web reaches the drum 27. Alternatively, timed patches of adhesive may be applied to the strips cut from the web while they are on the drum 27.

The timing of the delivery of the strips to the rods may be controlled as follows. An optical device 31 shown in FIG. 1 detects and signals the arrival of the filters, and the signals are used to control the timing or phasing of a motor (not shown) during the strip-feeding parts. For example, the motor may be one of the low-inertia "printed circuit" motors, which can be finely adjusted as to its speed. By this means it is possible to ensure that the strips of uniting material arrive at the rod line appropriately timed in relation to the filter portions. That is to say, any tendency for the positions (i.e. the timing of arrival of the filters) to drift over a period of time can be compensated by appropriate automatic adjustment of the timing of delivery of the strips.

Reference is directed also to our British patent specification No. 814,383 various details from which may be used in carrying out the present invention.

I claim:

1. Apparatus for making and packing filter cigarettes comprising a rod-making machine including means for forming a continuous tobacco-filled rod, means for cutting the rod at regular intervals to form double-length tobacco rods, means for spacing the tobacco rods apart while they are moving longitudinally, means for inserting double-length filter portions between successive rods, means for cutting from a continuous web of uniting material strips each having a length adapted for extending along the entire length of a double-filter portion and overlapping the adjacent ends of the adjacent tobacco rods, means for feeding the strips at spaced intervals onto the filter portions and tobacco rods, means for detecting the positions of the strips, means responsive to the detector for controlling the said feed means for maintaining correct delivery of the strips onto the filter portions and tobacco rods, means for wrapping the strips around the tobacco rods and filter portions to form a continuous rod comprising alternate double tobacco and filter portions, and means for cutting the continuous rod through the middle of each double-filter portion to form double-cigarette units wherein the tobacco is sealed in each double-length tobacco rod by filter portions secured to the opposite ends thereof; at least one cigarette packing machine for packing individual filter cigarettes; conveying apparatus for conveying the double-cigarette units from the rod-making machine to the packing machine and including or having associated therewith a cigarette storage apparatus; and cutting means located at the packing machine for cutting the double-cigarette units through the middle to form individual filter cigarettes prior to the packing thereof by the packing machine.

2. Apparatus according to claim 1 in which the rod-making machine includes an air-pervious carrier tape which is arranged to carry the strips of uniting material onto the rods by means of suction applied through the tape to hold the strips on the tape, the tape being constrained to bend progressively in cross-section so as to begin the operation of folding the strips around the rods.

3. Apparatus according to claim 2 in which the rod-making machine includes a rotary folding member having at least one strip-engaging part which is timed to engage a strip during each revolution of the rotary member.

4. A machine according to claim 1 in which the rod-making machine includes a drum with suction ports arranged to feed the adhesive-coated strips onto the filter portions and rods, and in which a tape is arranged to commence the folding of the strips around the rods.

5. Apparatus according to claim 1 in which the rod-making machine includes means for spacing apart the tobacco rods comprises a suction conveyor arranged to move in the same direction but at a speed greater than that of the initial continuous tobacco rod.

6. A machine for making filter cigarettes comprising means for forming a continuous tobacco-filled rod, means for cutting the rod at regular intervals to form double-length tobacco rods, means for spacing the tobacco rods apart while they are moving longitudinally, means for inserting double-length filter portions between successive rods, means for applying strips of uniting material at regular intervals so that each strip extends along the entire length of a double-filter portion and overlaps the adjacent ends of the adjacent tobacco rods, means for wrapping the strips around the tobacco and filter portions to form a continuous rod comprising alternate double tobacco and filter portions, and means for cutting the continuous rod at regular intervals to form individual rods each including a tobacco-filled portion and a filter portion, the means for applying strips of uniting material comprising means for feeding a web of uniting material at a predetermined speed towards a drum having suction ports whereby the web and strip portions cut therefrom are gripped by the drum, a rotary web cutting device including at least one knife for cutting the web at regular intervals in cooperation with the drum, the said knife and the said drum having a peripheral speed greater than the said predetermined speed of the web whereby spaced strips are produced on the drum by successive cutting operations, an air-pervious tape backed by a suction chamber and arranged to receive the strips from the drum, and means for guiding the said tape past the drum and then into line with the axially-moving tobacco rods and filter portions and for folding the tape so as at least to commence the wrapping of each strip around a corresponding double-filter portion and the adjacent ends of the adjacent tobacco rods.

7. A machine for making filter cigarettes comprising means for forming a continuous tobacco-filled rod, means for cutting the rod at regular intervals to form double-length tobacco rods, means for spacing the tobacco rods apart while they are moving longitudinally, means for inserting double-length filter portions between successive rods, means for applying strips of uniting material at regular intervals so that each strip extends along the entire length of a double-filter portion and overlaps the adjacent ends of the adjacent tobacco rods, means for wrapping the strips around the tobacco and filter portions to form a continuous rod comprising alternate double tobacco and filter portions, and means for cutting the continuous rod at regular intervals to form individual rods each including a tobacco-filled portion and a filter portion, the means for applying strips of uniting material comprising means for feeding a web of uniting material at a predetermined speed towards a drum having suction ports whereby the web and strip portions cut therefrom are gripped by the drum, a rotary web cutting device including at least one knife for cutting the web at regular intervals in cooperation with the drum, the said knife and the said drum having a peripheral speed greater than the said predetermined speed of the web whereby spaced strips are produced on the drum by successive cutting operations, an air-pervious tape backed by a suction chamber and arranged to receive the strips from the drum, means for guiding the said tape past the drum and then onto line with the axially moving tobacco rods and filter portions and for folding the tape so as at least to commence the wrapping of each strip around a corresponding double-filter portion and the adjacent ends of the adjacent tobacco rods, a detector for detecting the positions of the web portions on the tape, and means responsive to the detector for controlling simultaneously the drive means for the drum, the cutting device and the web feeding means, whereby the timing of delivery of strips by the tape with respect to the filter rods is maintained.

* * * * *